US006057763A

United States Patent [19]

Brace et al.

[11] Patent Number: 6,057,763

[45] Date of Patent: May 2, 2000

[54] METHOD AND APPARATUS FOR ACTIVATING AND DEACTIVATING ELECTROMAGNETIC ARTICLE SURVEILLANCE MARKERS

[75] Inventors: Thomas J. Brace, Woodbury; James E. Fergen, North St. Paul; Michael J. Kieffer, Apple Valley, all of Minn.; Kathleen M. McLeod, London, Canada; Peter J. Zarembo, Shoreview, Minn.

[73] Assignee: 3M Innovative Properties Company, St. Paul, Minn.

[21] Appl. No.: 09/058,636

[22] Filed: Apr. 10, 1998

[51] Int. Cl.[7] ..... G08B 13/14

[52] U.S. Cl. ..... 340/572.1; 335/284

[58] Field of Search ..... 340/551, 572.1, 340/572.3; 335/284

[56] References Cited

U.S. PATENT DOCUMENTS

| | | | |
|---|---|---|---|
| 3,747,086 | 7/1973 | Peterson | 340/280 |
| 4,623,877 | 11/1986 | Buckens | 340/572 |
| 4,684,930 | 8/1987 | Minasy et al. | 340/551 |
| 4,689,590 | 8/1987 | Heltemes | 335/284 |
| 4,752,758 | 6/1988 | Heltemes | 335/284 |
| 4,800,353 | 1/1989 | Csonka et al. | 335/210 |
| 5,187,462 | 2/1993 | Montean | 335/284 |
| 5,225,807 | 7/1993 | Zhou et al. | 340/551 |
| 5,285,182 | 2/1994 | Zarembo | 335/284 |
| 5,477,202 | 12/1995 | Zarembo et al. | 340/572.3 |
| 5,500,640 | 3/1996 | Zhou et al. | 340/572 |
| 5,594,420 | 1/1997 | Copeland et al. | 340/572 |
| 5,625,339 | 4/1997 | Zarembo et al. | 340/551 |
| 5,805,065 | 9/1998 | Schwarz et al. | 340/551 |
| 5,844,485 | 12/1998 | Ryan, Jr. | 340/572.3 |

FOREIGN PATENT DOCUMENTS

| | | | |
|---|---|---|---|
| WO 95/24704 | 9/1995 | WIPO | G08B 13/24 |

OTHER PUBLICATIONS

Brochure entitled "Express Self–Service Check–Out Station for Increased Library Productivity and Service" by Knogo Corporation; Cat. #17EXP–Feb. 1994USA.

Brochure entitled "Book Protection System" by IDEC.

Brochure entitled "Book Counter, Mark2 for self–service loan/return/borrowers account" by Codeco ApS.

Brochure entitled "The Fast Track—to save Staff Time . . . Patron Time . . . " by NEWCIRC technology.

*Primary Examiner*—Nina Tong

*Attorney, Agent, or Firm*—Peter L. Olson

[57] ABSTRACT

The present disclosure relates to an apparatus for activating and deactivating an electronic article surveillance marker carried by an article. The apparatus includes a housing having a platform for supporting the article. The apparatus also includes a first magnet positioned within the housing adapted for producing a magnetic field of sufficient strength to deactivate the marker. Additionally, the apparatus includes a translating mechanism for translating the first magnet between first and second positions along the platform. The electronic article surveillance marker is deactivated by placing the article onto the platform and translating the first magnet between the first and second positions. The first magnet can also be part of an alternating decaying array of magnets adapted for either activating or deactivating the electronic surveillance marker.

41 Claims, 8 Drawing Sheets

METHOD AND APPARATUS FOR ACTIVATING AND DEACTIVATING ELECTROMAGNETIC ARTICLE SURVEILLANCE MARKERS

TECHNICAL FIELD

The present invention relates generally to electromagnetic article surveillance (EAS) systems. More particularly, the present invention relates to methods and apparatuses for sensitizing and desensitizing EAS markers that are attached to articles to prevent theft of such articles.

BACKGROUND OF THE INVENTION

EAS systems are typically used to prevent the unauthorized removal of articles or merchandise from public places such as stores or libraries. Articles that are frequently subject to theft include books, audiotapes, videotapes, and compact discs. EAS systems generally use EAS markers, which can be selectively sensitized or desensitized, that are placed on articles desired to be protected. The markers work in combination with detectors typically located at the exits of the area containing the marked articles. When a particular marker is desensitized, it can be moved past the marker detector without activating an alarm. When the marker is sensitized, the marker will trigger an alarm when it is moved past the marker detector. EAS markers are commonly desensitized by desensitizing machines that are under the exclusive control of authorized personnel.

One common type of marker detector uses an alternating magnetic interrogation field that is generated at the exits of the area protected by an EAS system. A marker used in association with such a detector typically includes an elongated strip of low-coercivity magnetic material in which the domains of the low-coercivity magnetic material are alternately switched in polarity from north to south and back. The low coercivity magnetic material disturbs the magnetic interrogation field in a detectable manner, which triggers an alarm. The alarm indicates that the article carrying the marker has not been properly checked out.

Throughout the specification, the terms desensitize and deactivate have been used interchangeably with respect to surveillance markers. Generally, such terms are intended to mean that a given surveillance marker has been transformed to a state where the marker will not trigger or set off an EAS detector. One particular type of marker suitable for use with the present invention includes an elongated strip of low-coercivity magnetic material that is divided into multiple sections by at least one magnetizable section (referred to as a "keeper") having a higher magnetic coercivity. Such a marker is preferably desensitized or deactivated by magnetizing the keepers of the marker. When the keepers are magnetized, the marker will not be detected when placed in an alternating magnetic field interrogation zone generated by an EAS detector. When the keepers are demagnetized, thus activating the marker, the marker will be detected. One example of a such a marker is available from Minnesota Mining and Manufacturing Company of St. Paul, Minn. (3M) under the designation DSB-2, which is sold under the name TATTLETAPE™. This marker is described in U.S. Pat. No. 3,747,086, which is incorporated by reference herein.

Although the prior art provides magnets for desensitizing markers on articles, there are some limitations to the conventional approaches. First, some of these approaches allow for the marker to pass the desensitizing magnet while the magnet is not optimally oriented for desensitizing the marker. For example, the magnetic field profile to which the marker is exposed may be asymmetrical, or may present an odd number of magnetic transitions with regards to this marker. As a result, the marker may be inadvertently resensitized after being desensitized, and thus trigger an alarm when none is intended. Similarly, the prior art approaches may fail to desensitize the marker at all if the magnet is not properly aligned with the marker, or the entire marker is not moved past the magnet. In any of these situations, a marker can then trigger an alarm when a patron attempts to exit the library.

The present invention provides solutions to these and other problems, and offers other advantages over the prior art designs.

SUMMARY OF THE INVENTION

The present invention relates generally to arrangements and methods for deactivating electronic article surveillance markers efficiently and conveniently. Furthermore, the various methods and arrangements are adapted for accommodating articles having electronic article surveillance markers positioned at various locations and orientations.

One arrangement in accordance with the principles of the present invention includes a carriage adapted for movement between a first position and a second position relative to an article having an EAS marker desired to be deactivated. The arrangement also includes a first magnet carried by the carriage at a position aligned relative to an expected position of the marker. The first magnet is adapted to produce a magnetic field of sufficient strength to deactivate or desensitize the marker as the carriage moves translationally. The arrangement further includes a moving means operatively coupled to the carriage for moving the carriage between the first and second positions to deactivate the marker.

Another arrangement in accordance with the principles of the present invention includes a platform for holding an article carrying an EAS marker desired to be deactivated. The platform extends between a first position and a second position. The arrangement also includes a deactivating means for producing a magnetic field of sufficient strength to deactivate the marker. The arrangement further includes a guide means for guiding the deactivating means along the platform between the first position and the second position. Finally, the arrangement includes a motor operatively coupled to the guide means for moving the deactivating means between the first and second positions.

A further arrangement in accordance with the principles of the present invention includes a housing having a platform for supporting an article that carries an EAS marker. The apparatus also includes a first magnet positioned within the housing. The first magnet is capable of producing a magnetic field of sufficient strength to deactivate the marker. The apparatus further includes a translating mechanism for translating the first magnet between first and second positions along the platform. The electronic article surveillance marker is deactivated by placing the article on the platform and translating the first magnet between the first and second positions.

An additional arrangement in accordance with the principles of the present invention includes an alternating decaying array of magnets adapted for selectively either activating or deactivating an EAS marker. The alternating decaying array of magnets is preferably configured for translational movement in first and second opposite directions. When the array is translated in the first direction relative to the marker, the array is adapted to activate the marker. When the array is translated in the second direction relative to the marker, the array is adapted to deactivate the marker.

A further aspect of the present invention relates to a method for deactivating an electronic article surveillance marker carried by an article and located at an expected position between a first position and a second position. The method includes the step of providing guide means adapted for translational movement between the first and second positions. The method also includes the step of providing a deactivating means for producing a magnetic field of sufficient strength to deactivate the marker. The deactivating means is carried by the guide means at a position aligned relative to the expected position of the marker. Finally, the method includes the step of driving the deactivating means between the first and second positions such that the surveillance marker is deactivated.

The various aspects and arrangements of the present invention provide apparatuses and methods that allow EAS markers to be conveniently and efficiently activated or deactivated. For example, the various arrangements and aspects provide methods and apparatuses that allow EAS markers to be deactivated without requiring such markers to be manually moved relative to a magnetic field. Also, the present invention provides deactivating apparatuses arranged and configured to accommodate articles having electronic article surveillance markers mounted at various locations. For example, certain embodiments of the present invention are adapted for deactivating electronic article surveillance markers mounted adjacent the spines of books and on the surfaces of compact discs. In one particular embodiment of the present invention, two magnets are aligned at right angles relative to one another in order to accommodate the various possible EAS marker locations associated with books and compact discs.

BRIEF DESCRIPTION OF THE DRAWINGS

The accompanying drawings, which are incorporated herein and constitute a part of this specification, illustrate several aspects of the invention and together with the description, serve to explain the principles of the invention. In the drawings.

DETAILED DESCRIPTION OF THE INVENTION

Figure 1:
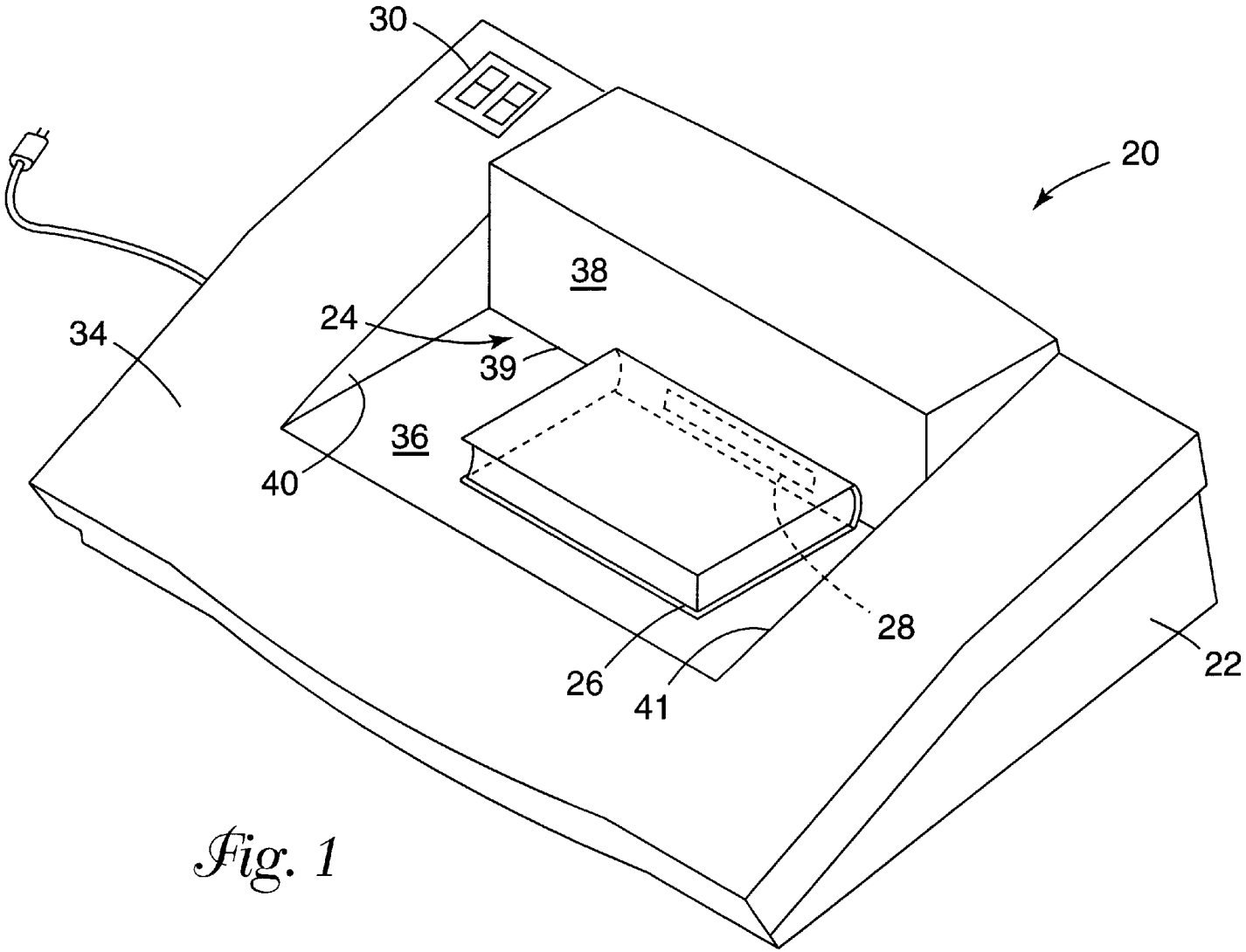
FIG. 1 is a perspective view of an apparatus, constructed in accordance with the principles of the present invention, for activating or deactivating electronic article surveillance markers.

FIG. 1 illustrates an electronic surveillance marker sensitizer/desensitizer 20 constructed in accordance with the principles of the present invention. Generally, the sensitizer/desensitizer 20 includes a housing 22 defining a cradle 24 adapted for receiving an article carrying a surveillance marker (shown in ghost lines at 28) desired to be activated or deactivated. The sensitizer/desensitizer 20 is activated by control panel 30 having one or more buttons or other devices that interface with control circuitry for controlling the operation of the unit. Those skilled in the art will recognize that a variety of known software or hardware driven approaches can be employed to control the operation of the unit.

In use of the sensitizer/desensitizer 20, an article (shown as book 26, though it could be magnetic or optical media, a container, or any other article of interest) is first placed in the cradle 24 of the housing 22. The sensitizer/desensitizer 20 is then activated via the control panel 30. During the deactivating process, the article typically remains substantially stationary with respect to the housing 22. After the deactivating process has been completed, the article can be removed from the cradle 24 and replaced with a subsequent article having a marker desired to be deactivated.

Figure 2:
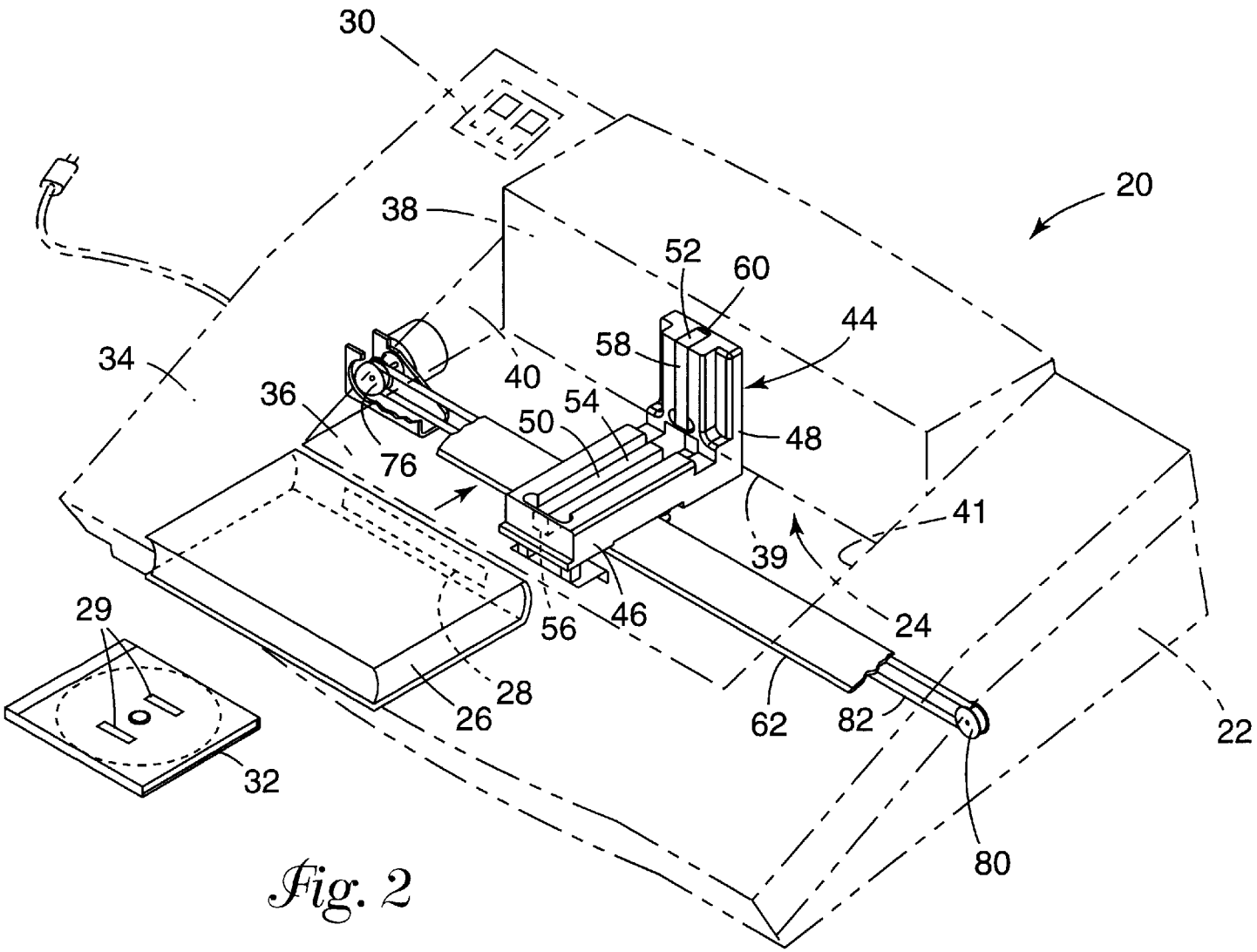
FIG. 2 illustrates a deactivating mechanism incorporated within the apparatus of FIG. 1.

The sensitizer/desensitizer 20 is preferably adapted to activate or deactivate a variety of different articles, such as books, magnetic media, and compact discs, either sequentially or simultaneously. Such articles often have surveillance markers mounted at significantly different locations. For example, as shown in FIG. 2, the expected position of a marker 28 on a book 26 is along the spine of the book 26. In contrast, the expected position of a marker 29 on a compact disc 32 is on the face of the compact disc 32, and the compact disc may have more than one marker. As will be described in greater detail later in the specification, the sensitizer/desensitizer 20 preferably includes structure for allowing the unit to deactivate surveillance markers positioned at different locations on various articles. Such a function is preferably achieved without requiring a user of the sensitizer/desensitizer 20 to move the article relative to the unit.

The housing 22 of the sensitizer/desensitizer 20 has a front face 34 that is generally inclined. The cradle 24 is formed in the front face 34 of the sensitizer/desensitizer 20 and includes a generally horizontal platform 36 adapted for supporting an article such as the book 26 or the compact disc 32. The platform 36 adjoins a guide wall 38 at a rear edge 39 of the cradle 24. The guide wall 38 projects upward from the platform 36. In one embodiment, the platform 36 is tilted between five degrees and twenty degrees relative to the horizontal plane, thereby urging the article on the platform 36 toward the guide wall 38. Further, in this embodiment, the angle between the platform 36 and guide wall 38 at rear edge is between eighty and one hundred and twenty degrees. The cradle 24 further includes oppositely disposed generally triangular first and second end walls 40 and 41 that are preferably transversely aligned with respect to both the platform 36 and the guide wall 38.

FIGS. 2 through 4A illustrate a desensitizing arrangement positioned within the housing 22 generally adjacent to the cradle 24. The desensitizing arrangement includes a carriage 44 having a generally L-shaped configuration. The L-shaped configuration allows for markers located adjacent the platform 36 or guide wall 38 to be deactivated. The carriage 44 includes first and second legs 46 and 48 aligned substantially at right angles with respect to one another. The first leg 46 is substantially horizontal and is positioned directly below the platform 36 of the cradle 24, and the second leg 48 is substantially vertical and is disposed directly behind the guide wall 38 of the cradle 24. The legs are preferably oriented at the same angles as the cradle and guide wall, and are sufficiently close thereto to carry the magnets described below in close proximity to those surfaces.

First and second magnets 50 and 52 are connected, secured, or otherwise mounted on the first and second legs 46 and 48, respectively, of the carriage 44. As shown in FIG. 2, the first and second magnets 50 and 52 each have an elongated, generally rectangular shape and are mounted within elongated, generally rectangular channels defined by the first and second legs 46 and 48.

As positioned on the carriage 44, the first magnet 50 has a top face 54 that is substantially horizontal and is positioned directly below the platform 36 of the cradle 24. The first magnet 50 also includes a bottom face 56 that is opposite the top face 54. The second or vertical leg 48 of the carriage 44 is oriented such that the second magnet 52 extends generally perpendicularly to the first magnet 50 and has a front face 58 that is directly adjacent and substantially parallel to the guide wall 38 of the cradle 24. The second magnet 52 has a back face 60 that is opposite the front face 58.

The first and second magnets 50 and 52 are preferably permanent magnets each having opposite poles. Preferably, the first magnet 50 has a first pole at the top face 54 and a second pole at the bottom face 56, while the second magnet 52 preferably has a first pole at the front face 58 and a second pole at the back face 60. For example, the top and front faces 54 and 58 of the first and second magnet 50 and 52 can comprise the north poles of such magnets, while the bottom and rear faces 56 and 60 can comprise the south poles of such magnets. However, the respective polarities of the pair of magnets 50 and 52 could be reversed without adversely affecting the operation of the desensitizer.

The first and second magnets 50 and 52 are preferably permanent neodymium iron boron magnets having a generally rectangular cross-section. Magnets suitable for use in association with the present invention are sold by Dexter Magnetic Materials Division of Dexter Corporation under the name Nd35, Nd38, Nd40, Nd45, and Nd48. Based on the expected position of surveillance markers on the device, the first magnet 50 is typically expected to deactivate or desensitize markers 29 located on the faces of compact discs. In contrast, the second magnet 52 is typically expected to deactivate surveillance markers located in the spines or gutters of books.

The field strength of the first and second magnets 50 and 52 should be sufficient to magnetize the keepers (and thus deactivate the markers, as described above) at whatever orientation the marker presents itself to the field. The effective distance (the maximum distance from the magnets to the marker that will enable the markers to be deactivated) is a function of the parameters of the first and second magnets 50 and 52, the orientation of the markers, and the coercivity of the keepers. In one embodiment, which provides an approximate field strength of 530 Gauss at an effective distance of 0.76 cm (0.3 inches) from platform 36 sufficient for the first magnet 50 to deactivate two markers on the face of a compact disc regardless of their orientation, the first magnet 50, fabricated of Nd38 magnet material, preferably has a length in the range of 12 cm (4.75 inches), a face width in the range of 1.27 cm (0.5 inches), and a thickness or depth in the range of 2.3 cm (0.9 inches). To provide an approximate magnetic field strength 250 Gauss at an effective distance of 2.2 cm (0.875 inches) from guide wall 38, the second magnet 52 in this embodiment is fabricated from Nd48 material, has a length in the range of 8.25 cm (3.25 inches), a face width in the range of 1.4 cm (0.55 inches), and a thickness or depth in the range of 2.54 cm (1.0 inch).

The difference in magnetic field strengths between the first and second magnets 50 and 52 relates to the expected locations and orientations of the surveillance markers that the first and second magnets 50 and 52 are intended to deactivate. For example, the second magnet 52 is intended to deactivate surveillance markers 28 positioned adjacent the spine or gutter of a book, but at a distance of up to 2.2 cm (0.875 inches) from guide wall 38. When articles such as books are placed on the platform 36, their corresponding markers align generally perpendicular with respect to the poles and long axis of the second magnet 52. Such a perpendicular arrangement represents an optimal condition for deactivating such surveillance markers. In contrast, the first magnet 50 is typically used to deactivate surveillance markers 29 positioned on the faces of compact discs 32 carried inside a single height compact disc case. When a compact disc case is placed on the platform 36, its corresponding surveillance marker is unlikely to be aligned perpendicular to the major axis of the first magnet 50. In fact, a certain percentage of the time, the surveillance marker 29 on the compact disc 32 will be aligned parallel to the major axis of the first magnet 50, which presents a difficult arrangement for deactivating a surveillance marker. Consequently, the first magnet 50 preferably has a magnetic field strength that is large enough to ensure that the magnet will effectively deactivate surveillance markers even when such markers are aligned parallel to the major axis of the first magnet 50.

Figure 2A:
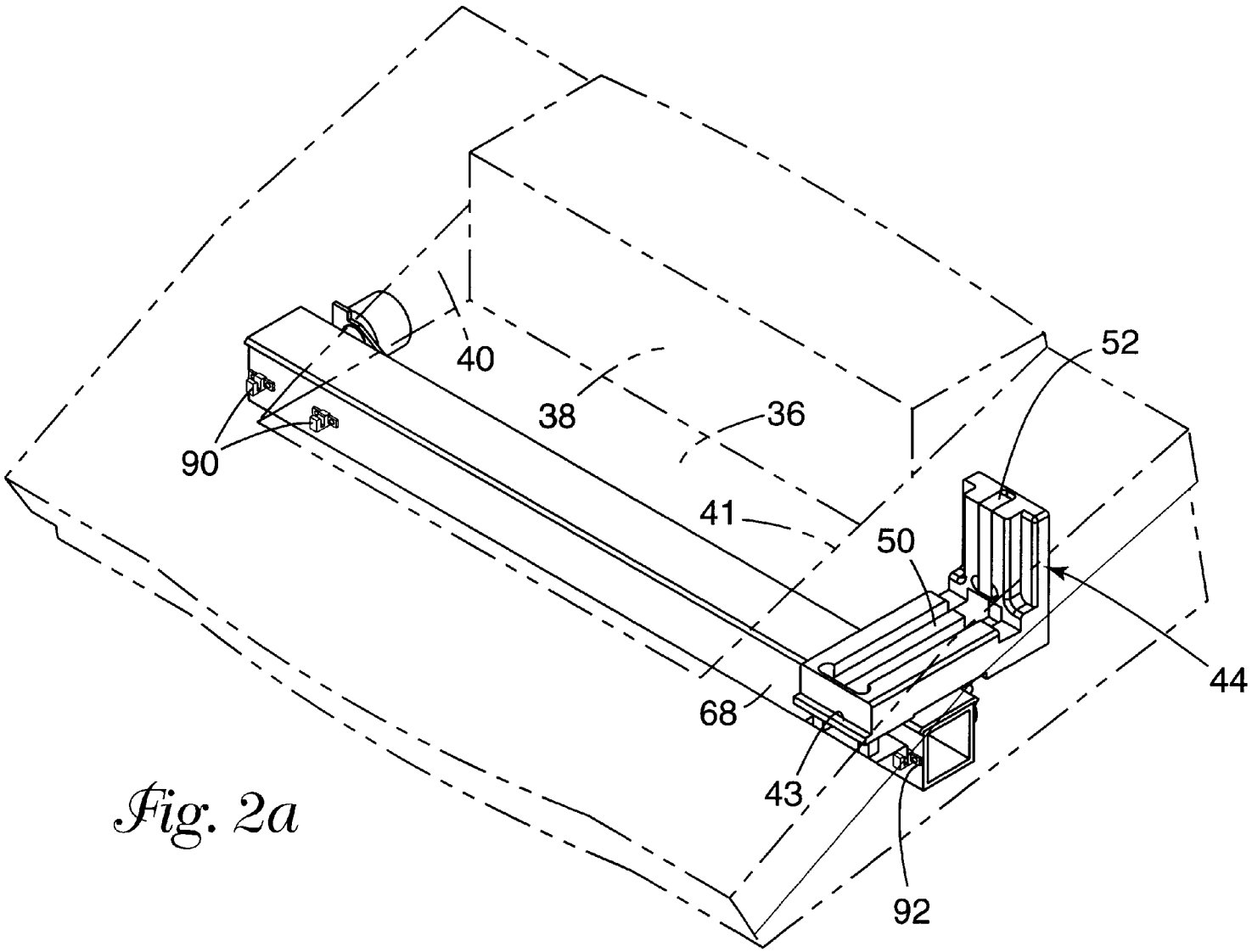
FIG. 2A illustrates a deactivating mechanism incorporated within the apparatus of FIG. 1 with the carriage in the rest position.

The carriage 44 of the desensitizing arrangement is arranged to reciprocate or translate back and forth along the cradle 24. Specifically, the desensitizing arrangement includes a translating mechanism for translating the carriage 44 back and forth between a first position located adjacent the first end wall 40 and a second position adjacent the second end wall 41. As shown in FIGS. 1 through 4, the carriage 44 is guided between the end walls 40 and 41 by an elongated, generally linear track or guide rail 62 that extends between the end walls 40 and 41 and is positioned below the platform 36. The carriage 44 is slidably connected to the guide rail 62 by a plurality of guide wheels or rollers 64. The rollers are rotatably connected to the bottom of the carriage 44 and define channels for receiving opposite edges of the guide rail 62. The guide rail 62 is supported on an elongated base member 68 that is secured within the housing 22. The guide rail 62 is preferably positioned such that when the carriage 44 is mounted thereon, the first magnet 50 is aligned directly below the platform 36 of the cradle 24, and the second magnet 52 is aligned directly behind the guide wall 38 of the cradle 24. As shown in FIG. 2A, the guide rail 62 preferably extends beyond the first and second end walls 40 and 41 such that the carriage 44 can be translated from a rest position located beyond the first end wall 40 to a rest position located beyond the second end wall 41.

Figure 3:
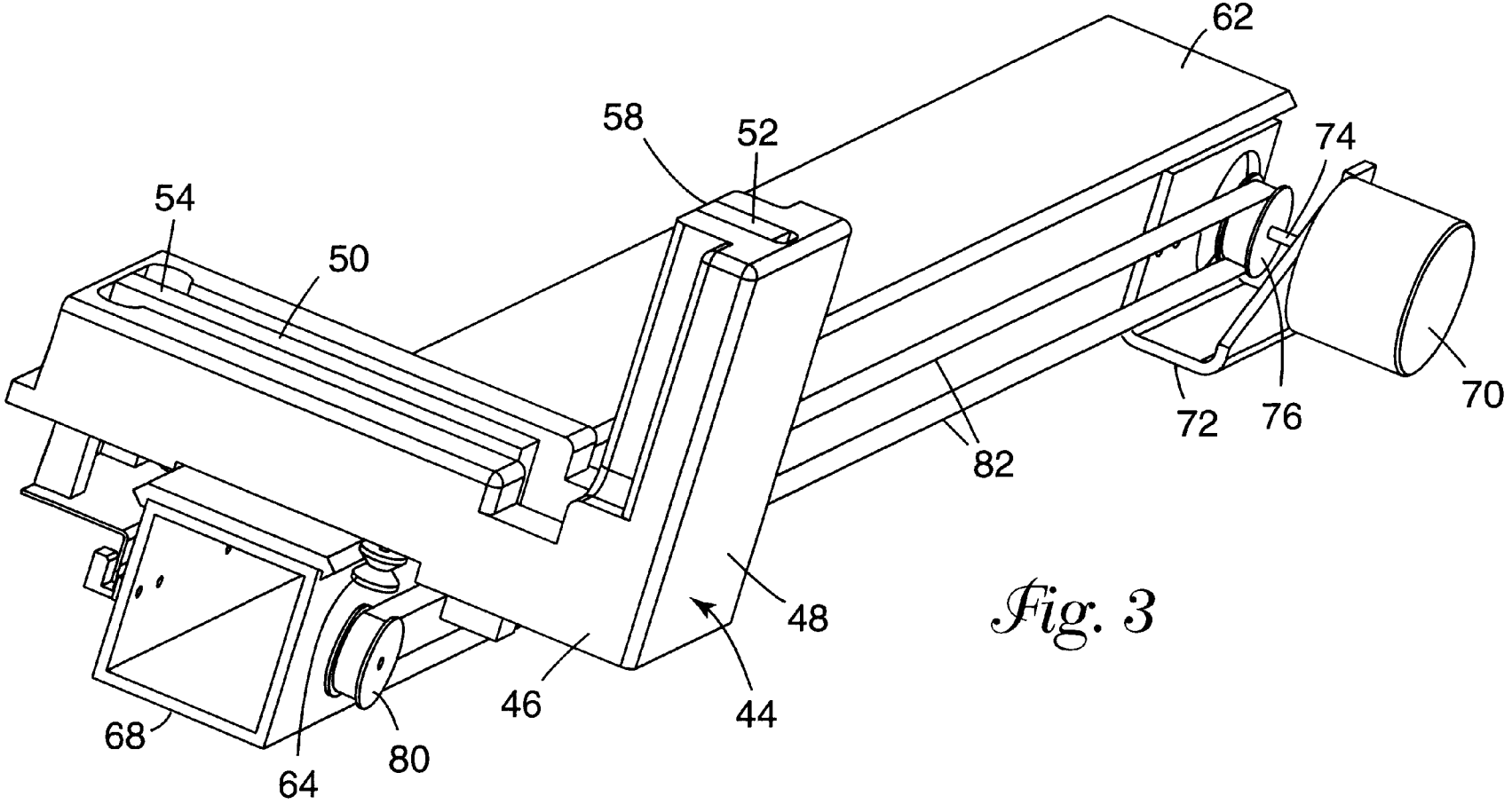
FIG. 3 illustrates an enlarged perspective back view of the deactivating mechanism of FIG. 2.

As shown in FIG. 3, the desensitizing arrangement also includes a drive mechanism for moving the carriage 44 back and forth along the guide rail 62. The drive mechanism includes a drive motor 70, which can be of any suitable type, that is connected to the base member 68 by a bracket 72. Exemplary motors include electrically powered stepper motors and servo motors. The drive mechanism can also use other sources of drive power such as manual cranks, actuators, solenoids, or any other type of known drive source suitable for applying a sufficient force to the carriage 44 to propel it along the guide rail 62.

Referring to FIG. 3, the drive motor 70 has a drive shaft 74 that is connected to a drive pulley 76 such that when the drive motor 70 is activated, drive shaft 74 rotates the drive pulley 76. The drive pulley 76 is located adjacent one end of the guide rail 62 and an idler pulley 80 is located adjacent the other end of the guide rail 62. A continuous driven member such as a drive belt 82 or chain is looped around or mounted on the drive and idler pulleys 76 and 80. The carriage 44 is fixedly secured to the drive belt 82 via conventional techniques such as a belt clamp. By selectively propelling the belt 82 in first and second opposite directions, the drive motor 70 functions to propel the carriage 44 back and forth along the guide rail 62.

Figure 3A:
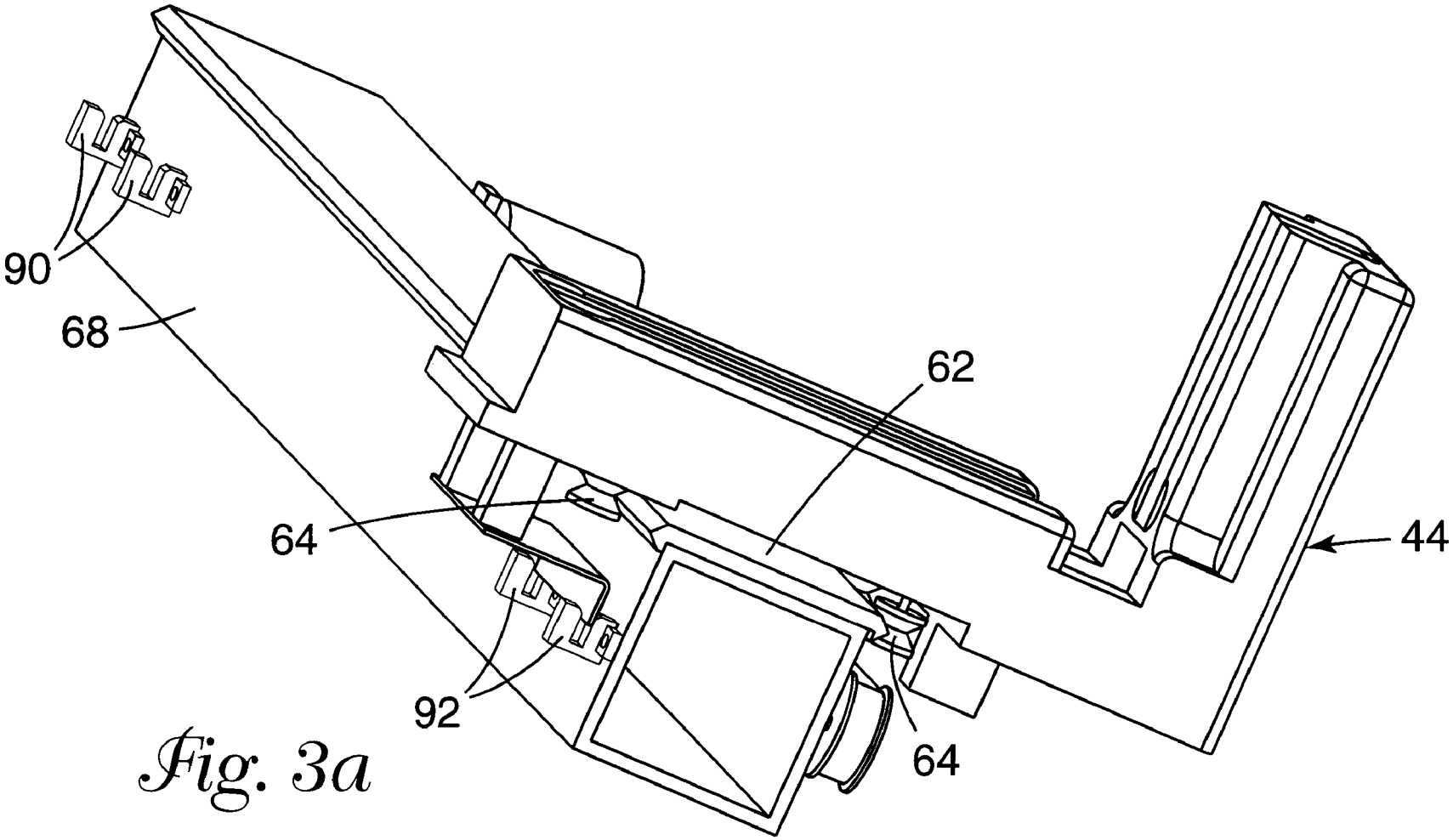
FIG. 3A illustrates a front view of the deactivating mechanism of FIG. 3.

Referring to FIGS. 2A and 3A, a pair of sensors 90 and 92 is mounted near each end of the elongated base member 68. Each of the sensor pairs includes a decelerate sensor located toward the center of the elongated base member 68. The decelerate sensor communicates with the motor control to reduce the motor speed, reducing the normal traverse speed of the carriage 44 once the carriage reaches the decelerate sensor. When both sensors of the pair are covered by the bracket 43 extending from the carriage 44, power is cut to the motor and the carriage 44 is immediately stopped.

Figure 4:
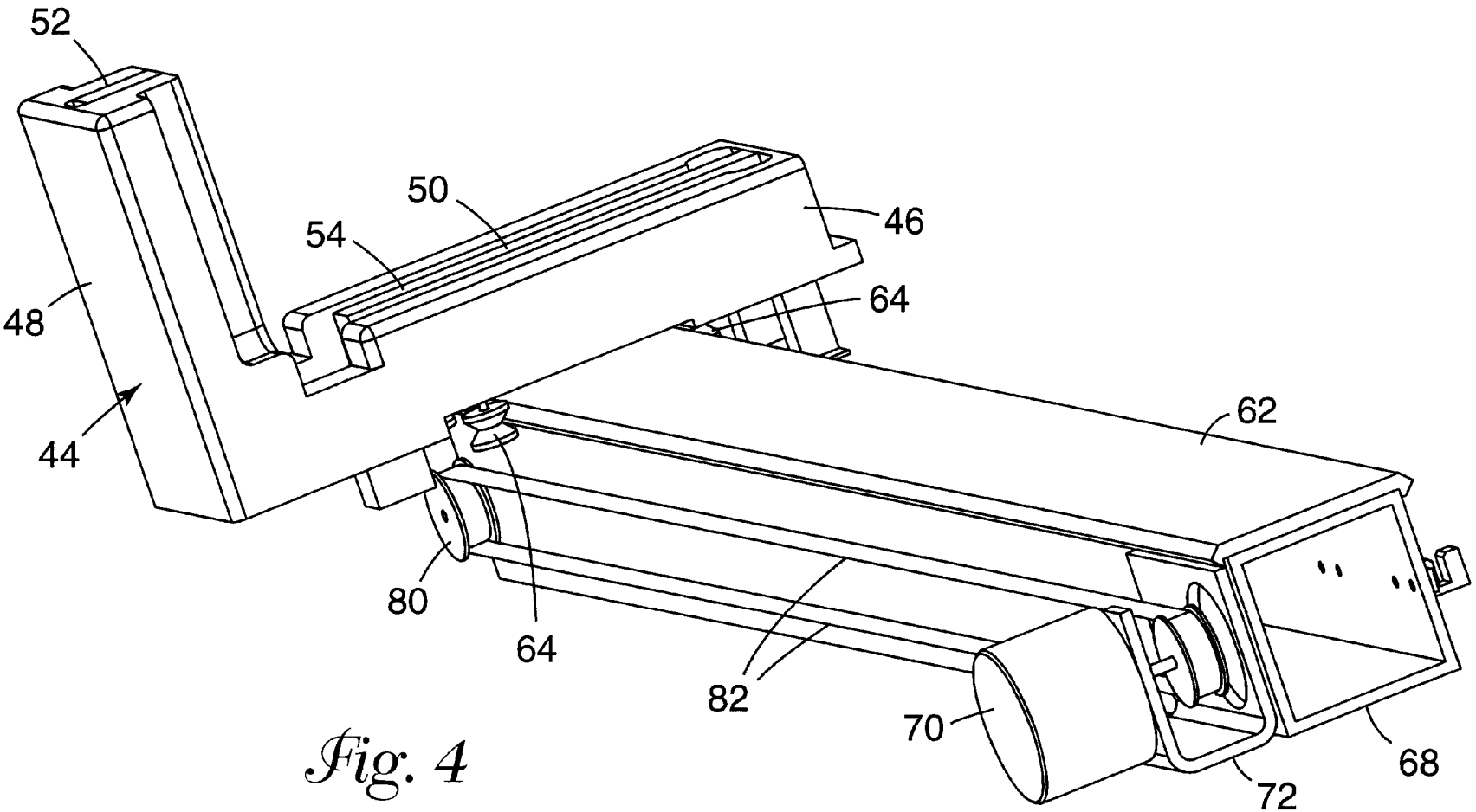
FIG. 4 provides another perspective view of the deactivating mechanism of FIG. 2.
Figure 4A:
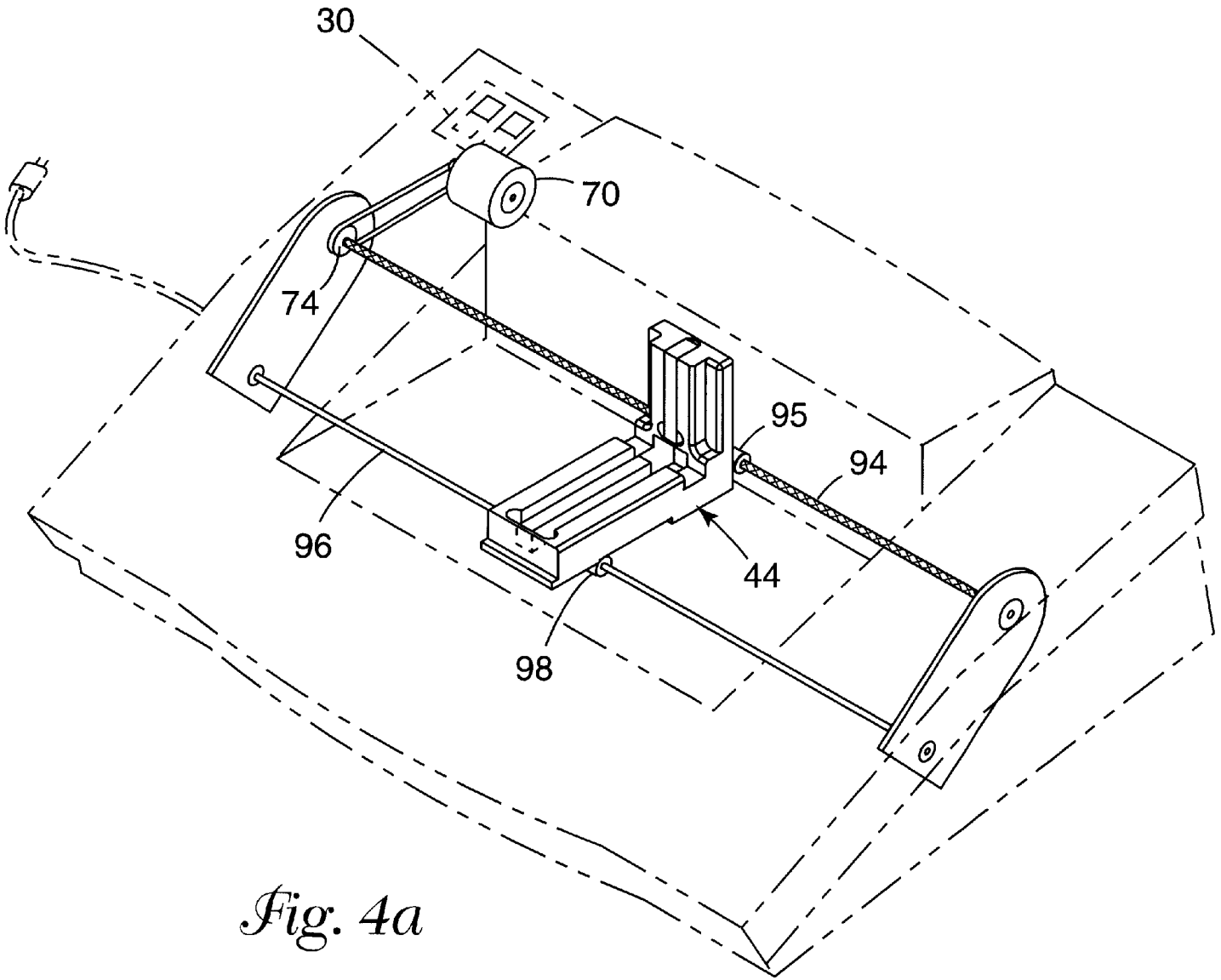
FIG. 4A provides a perspective view of another embodiment of the deactivating mechanism constructed in accordance with the principles of the present invention.

FIG. 4A illustrates an alternative arrangement for driving the carriage 44. In this configuration, a drive motor 70 is attached to a pulley 74 that is attached to a drive shaft 94. In one variation of this configuration, the drive motor 70 is a single direction device connected to a ball reverser shaft 94 (such as that manufactured by the Flennor Division of NORCO, of Ridgefield, Conn.), to which carriage 44 is slideably attached with ball reversing bearing 95. At the end of the shaft travel, the carriage automatically reverses its direction of travel. Sensors are located at each end of the shaft to stop the drive motor prior to the carriage reversal. In an alternate variation, a reversing motor 70 is attached to pulley 74, which is attached to a single direction threaded shaft. Sensors are located at each end of the shaft to stop the drive motor and prepare the drive motor to reverse direction. This configuration further includes a slide rail 96 slidingly connected to the carriage 44 by a slide bearing 98.

When the desensitizing mechanism is not in use, the carriage 44 preferably rests beyond either the first or second end wall, as shown in FIG. 2A. In use, an article having a surveillance marker desired to be deactivated is placed in the cradle 24, and the drive motor 70 is activated via the control panel 30. When the drive motor 70 is activated, the drive motor 70 causes the carriage 44 to be translated once along the guide rail 62 such that at least one of the magnets 50 and 52 swipes past the surveillance marker on the article to deactivate the marker. For example, referring to FIG. 2A, if the carriage 44 is initially located beyond the second end wall 41, the drive member 70 propels the drive belt 82 in a counterclockwise direction such that the carriage 44 moves across the cradle 24 from the second end wall 41 past the first end wall 40. In contrast, if the carriage 44 is initially located beyond the first end wall 40, the drive motor 70 propels the drive belt 82 in a clockwise direction such that the carriage 44 is moved across the cradle 24 from the first end wall 40 past the second end wall 41. After the carriage 44 moves past the article causing the article surveillance marker to be deactivated, the article can be removed from the cradle 24.

As illustrated in FIGS. 2A and 3, the belt 82 extends a distance beyond the end walls 40 and 41. When the unit is not in use, or the carriage has completed a pass across the platform 36, the carriage 44 rests at a location past the end wall 41. The location of the carriage 44 prevents a library patron from manually desensitizing a marker on a book or compact disc placed on the cradle 24. Also, resting the carriage 44 on the belt 82 at a location outside the end wall 41 reduces the effective magnetic field extending into the platform 36 that could otherwise damage magnetic material such video or audio tapes inadvertently placed on the platform.

Figure 5:
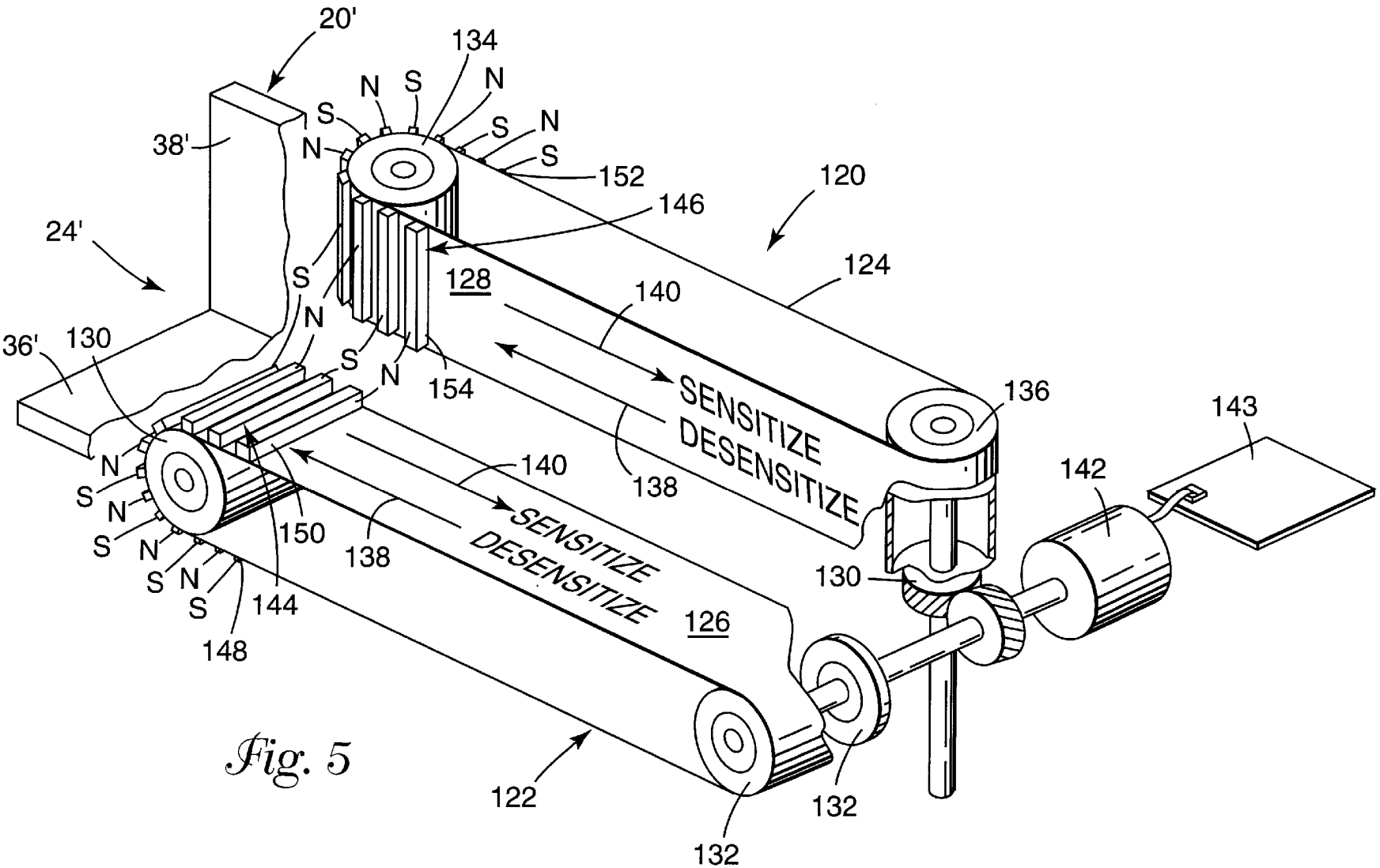
FIG. 5 illustrates another apparatus for activating and deactivating electronic surveillance markers that is constructed in accordance with the principles of the present invention.

FIG. 5 illustrates an alternative sensitizer/desensitizer 20' constructed in accordance with the principles of the present invention. Generally, the sensitizer/desensitizer 20' includes a housing having a cradle 24' formed by a platform 36' and a transverse guide wall 38'. The housing preferably has substantially the same configuration of the housing 22 illustrated in FIG. 1.

The sensitizer/desensitizer 120 includes a first belt 122 positioned directly beneath the platform 36' of the housing 22' and a second belt 124 positioned directly behind the guide wall 38'. The first belt 122 includes a top surface 126 that is substantially parallel to the platform 36', and the second belt 124 includes a front surface 128 that is substantially parallel to the guide wall 38'. The top surface 126 of the first belt 122 is preferably substantially perpendicular to the front surface 128 of the second belt 124.

The first belt 122 preferably extends completely along the length of the platform 36' and is mounted on first and second end rollers 130 and 132. Similarly, the second belt 124 preferably extends completely along the length of the guide wall 38' and is mounted on third and fourth end rollers 134 and 136. The first and second belts 122 and 124 are selectively driven in first and second directions 138 and 140 by a drive motor 142. The drive motor 142 is controlled by suitable control circuitry, processing means, or control means (indicated at 143) and is coupled to the second and fourth rollers 132 and 136 such that the belts 122 and 124 are selectively propelled by the drive motor 142 in closed loops about their respective pairs of end rollers.

The sensitizer/desensitizer 120 also includes first and second alternating decaying arrays of magnets 144 and 146. The first alternating decaying array of magnets 144 is mounted on the outer surface of the first belt 122, while the second alternating decaying array of magnets 146 is mounted on the outer surface of the second belt 124. The first alternating decaying array 144 includes a weakest magnet 148 disposed at one end of the array and a strongest magnet 150 disposed at the opposite end of the array. Similarly, the second alternating decaying array 146 includes a weakest magnet 152 positioned at one end of the array and a strongest magnet 154 disposed at the opposite end of the array. The weakest magnet 148 preferably has a magnetic field strength in the range of 80 Gauss measured at the face of platform 36' while the strongest magnet 150 preferably has a magnetic field strength in the range of 530 Gauss measured 0.76 cm. (0.3 inches) from the face of platform 36'. The weakest magnet 152 preferably has a magnetic field strength in the range of 80 Gauss measured at the face of guide wall 38' while the strongest magnet 154 preferably has a magnetic field strength in the range of 250 Gauss measured at 2.2 cm (0.875 inches) from the face of guide wall 38'. Other ranges and field strengths may also be used and remain within the scope of this invention.

In the first alternating decaying array 144, intermediate magnets are disposed between the weakest magnet 148 and the strongest magnet 150. The intermediate magnets are progressively stronger (and thus typically larger) in a direction extending from the weakest magnet 148 toward the strongest magnet 150. Similarly, in the second alternating decaying array 146, intermediate magnets are disposed between the weakest magnet 152 and the strongest magnet 154. Once again, the intermediate magnets are progressively stronger (and thus typically larger) in a direction extending from the weakest magnet 152 toward the strongest magnet 154. As shown in FIG. 5, the magnets of each alternating decaying array present alternating polarities such that neighboring magnets in the array present opposite polarities. Additionally, each of the magnets of each array is bipolar with a first pole facing toward a belt and a second pole facing away from the belt.

An electronic surveillance marker can be deactivated by the sensitizer/desensitizer 120 by placing an article carrying the marker in the cradle 24, and then activating the motor 142 such that the first and second belts 122 and 124 are driven in the first direction 138. As the first and second belts 122 and 124 are driven in the first direction 138, at least one of the first and second alternating decaying arrays 144 and 146 makes a whole number of passes (for example, 1, 2, or 3) across the marker. Because the arrays 144 and 146 are moved in the first direction 138, the strongest magnets 150 and 154 are the last magnets to pass the marker. The strongest magnets 150 and 154 preferably have sufficient magnetic field strength to magnetize the keepers and therefore deactivate the marker.

An electronic surveillance marker can be sensitized or activated by the sensitizer/desensitizer 120 by placing an article carrying the marker in the cradle 24, and then activating the motor 142 such that the first and second belts 122 and 124 are driven in the second direction 140. As the first and second belts 122 and 124 are driven in the second direction 140, at least one of the first and second alternating decaying arrays 144 and 146 makes a whole number of passes (for example, 1, 2, or 3) across the marker. Because the belts 122 and 124 are rotated in the second direction 140, the first magnets to pass the marker are preferably the strongest magnets 150 and 154, while the last magnets to pass the marker are preferably the weakest magnets 148 and 152. As the arrays 144 and 146 pass the marker, the marker is exposed to magnetic fields that rapidly alternate or reverse in direction. In other words, because each array 144 and 146 includes a plurality of magnets having alternating polarities, the marker is exposed to a plurality of magnetization reversals. Furthermore, because the arrays 44 and 46 are being moved in the second direction 140, the intensity of the reversing magnetic fields on the marker gradually decreases exponentially. Consequently, as the arrays 144 and 146 move past the marker, the magnetization of the marker approaches zero causing the marker to be activated/sensitized. Alternating decaying arrays of magnets are described more fully in U.S. Pat. Nos. 4,689,590 and 4,752,758, which are incorporated by reference herein.

With regard to the foregoing description, it is to be understood that changes may be made in detail, especially in matters of the construction materials employed and the shape, size, and arrangement of the parts without departing from the scope of the present invention. For example, structure used to desensitize a marker may also be used to sensitize a marker, as known in the art. It is intended that the specification in the depicted embodiment be considered exemplary only, with a true scope of the invention being set forth in the following claims.

We claim:

1. An arrangement for deactivating an electronic article surveillance marker carried by an article, the arrangement comprising:

(a) a carriage adapted for moving at least one magnet between a first position and a second position relative to the article;

(b) at least one first magnet carried by the carriage at a position aligned relative to an expected position of the marker and producing a magnetic field of sufficient strength to deactivate the marker as the carriage moves relative to the article; and (c) a motor operatively coupled to the carriage that, when activated, moves the carriage between the first position and the second position to deactivate the marker.

2. The arrangement according to claim 1, further including a belt operatively connected to the motor, wherein the belt moves the carriage between the first position and the second position.

3. The arrangement according to claim 2, further including a platform for holding the article between the first position and the second position.

4. The arrangement according to claim 3, wherein the first magnet is a bipolar magnet having a north pole and a south pole, one of the north or south poles facing the platform.

5. The arrangement according to claim 4, wherein the first magnet is positioned below the platform on a plane substantially parallel to the platform.

6. The arrangement according to claim 4, wherein the first magnet is generally parallel to the platform.

7. The arrangement according to claim 3, wherein the carriage is constructed and arranged as an angled bracket, the angled bracket having a first portion substantially parallel to the platform, and a second portion extending generally perpendicular to the first portion.

8. The arrangement according to claim 7, further comprising a second magnet producing a magnetic field of sufficient strength to deactivate the marker, the second magnet carried by the second portion of the angled bracket and the first magnet carried by the first portion of the angled bracket, the first and second magnets each having a north and a south pole, wherein the same pole on each of the first and second magnets faces the platform.

9. The arrangement of claim 3, wherein the magnet rests at a position where it is unable to deactivate the marker on an article placed on the platform.

10. The arrangement according to claim 1, further including a reversing screw operatively connected to the motor, wherein the carriage moves between the first position and the second position in response to rotational movement of the reversing screw.

11. The arrangement according to claim 10, further including a first guide rail extending between the first position and the second position, wherein the carriage slidingly engages the first guide rail.

12. The arrangement according to claim 1, further including a first guide rail extending between the first position and the second position, wherein the carriage slidingly engages the first guide rail.

13. The arrangement of claim 12, wherein the carriage slidingly engages the first guide rail via rollers.

14. An arrangement for deactivating an electronic article surveillance marker carried by an article, the arrangement comprising:

(a) a platform for holding the article, the platform extending between a first position and a second position;

(b) deactivating means for producing a magnetic field of sufficient strength to deactivate the marker;

(c) guide means for guiding the deactivating means along the platform between the first position and the second position, wherein the deactivating means is carried by the guide means; and (d) a motor operatively coupled to the guide means that, when activated, moves the deactivating means between the first and second positions.

15. The arrangement according to claim 14, wherein the deactivating means includes a first magnet having a north pole and a south pole, one of the north or south poles of the first magnet facing the platform.

16. The arrangement according to claim 15, further comprising a first pulley and a second pulley, the first pulley operatively coupled to the motor, and wherein the guide means includes a belt positioned adjacent the platform and extending between the first position and the second position, the belt engaging the first pulley and the second pulley and moving between the first position and the second position in response to rotational movement of the first pulley.

17. The arrangement according to claim 16, wherein the guide means further includes a carriage operatively coupled to the belt, and wherein the first magnet is carried by the carriage.

18. The arrangement according to claim 17, wherein the carriage is constructed and arranged as an angled bracket, the angled bracket having a first portion substantially parallel to the platform and a second portion extending upward from the first portion, and wherein the deactivating means further includes a second magnet, the second magnet carried by the second portion of the angled bracket and the first magnet carried by the first portion of the angled bracket, the first and second magnets each having a north and a south pole, wherein the same pole on each of the first and second magnets faces the platform.

19. The arrangement according to claim 15, wherein the guide means includes a carriage operatively coupled to the motor, the first magnet being carried by the carriage, and further includes a first guide rail extending between the first position and the second position, wherein the carriage slidingly engages the first guide rail.

20. The arrangement of claim 19, wherein the carriage slidingly engages the first guide rail via rollers.

21. The arrangement according to claim 19, wherein the carriage is constructed and arranged as an angled bracket, the angled bracket having a first portion substantially parallel to the platform and a second portion extending upward from the first portion and wherein the deactivating means further includes a second magnet, the second magnet carried by the second portion of the angled bracket and the first magnet carried by the first portion of the angled bracket, the first and second magnets each having a north and a south pole, wherein the same pole on each of the first and second magnets faces the platform.

22. The arrangement according to claim 21, wherein the guide means further includes a second guide rail extending between the first position and the second position, the second guide rail slidingly engaging the second portion of the angled bracket and the first guide rail slidingly engaging the first portion of the angled bracket.

23. The arrangement according to claim 14, wherein the deactivating means includes a linear array of magnets having an alternating field of increasing strength.

24. The arrangement according to claim 14, wherein the deactivating means rests at a position where it is unable to deactivate the marker on an article placed on the platform.

25. The method for deactivating an electronic article surveillance marker carried by an article and located at an expected position between a first position and a second position, the method comprising:

(a) providing guide means for effecting translational movement to guide a structure between the first position and the second position;

(b) providing deactivating means for producing a magnetic field of sufficient strength to deactivate the marker, wherein the deactivating means is carried by the guide means at a position aligned relative to the expected position of the marker; and (c) selectively effecting translational movement of the deactivating means between the first position and the second position.

26. The method according to claim 25, further including the step of positioning the article on a platform.

27. The method according to claim 26, wherein the deactivating means includes an array of magnets.

28. The method according to claim 26, wherein the means for deactivating includes a first magnet having a north pole and a south pole, one of the north or south poles of the first magnet facing the platform.

29. The method according to claim 28, further including the step of providing a first pulley and a second pulley, the first pulley operatively coupled to the motor, wherein the guide means includes a belt positioned adjacent the platform and extending between the first position and the second position, the belt forming a loop around the first pulley and the second pulley and moving between the first position and the second position in response to rotational movement of the first pulley.

30. The method according to claim 29, wherein the guide means further includes a carriage that moves with the belt, and wherein the first magnet is carried by the carriage.

31. The method according to claim 30, wherein the carriage is constructed and arranged as an angled bracket, the angled bracket having a first portion substantially parallel to the platform and a second portion extending upward from the first portion, and wherein the deactivating means further includes a second magnet, the second magnet carried by the second portion of the angled bracket and the first magnet carried by the first portion of the angled bracket, the first and second magnets each having a north and a south pole, wherein the same pole on each of the first and second magnets faces the platform.

32. The method according to claim 28, wherein the guide means includes a carriage operatively coupled to the motor, the first magnet carried by the carriage, and further includes a first guide rail extending between the first position and the second position, wherein the carriage slidingly engages the first guide rail.

33. The method accordingly to claim 32, wherein the carriage is constructed and arranged as an angled bracket, the angled bracket having a first portion substantially parallel to the platform and a second portion extending upward from the first portion, and wherein the deactivating means further includes a second magnet, the second magnet carried by the second portion of the angled bracket and the first magnet carried by the first portion of the angled bracket, the first and second magnets each having a north and a south pole, wherein the same pole on each of the first and second magnets faces the platform.

34. The method according to claim 33, wherein the guide means further includes a second guide rail extending between the first position and the second position, the second guide rail slidingly engaging the second portion of the angled bracket and the first guide rail slidingly engaging the first portion of the angled bracket.

35. An apparatus for desensitizing an electronic article surveillance marker carried by an article, the apparatus comprising:

(a) a housing having a platform for supporting the article;

(b) a first magnet positioned within the housing, the first magnet producing a magnetic field of sufficient strength to desensitize the marker; and (c) translating means that, when activated, moves the first magnet between first and second positions along the platform, whereby the electronic article surveillance marker may be desensitized.

36. The apparatus of claim 35, wherein the housing includes a cradle for receiving the article, the cradle being formed by the platform and a guide wall aligned in an upright position with respect to the platform.

37. The apparatus of claim 36, wherein the first magnet is positioned beneath the platform, and the apparatus further includes a second magnet that is positioned behind the guide wall.

38. The apparatus of claim 37, wherein the first and second magnets are generally perpendicularly aligned with respect to each other.

39. The apparatus of claim 35, wherein the first magnet is part of an alternating decaying array of magnets that is selectively moved by the translating means in first and second opposite directions along the platform, the array being adapted to desensitize the marker when moved in the first direction, and the array being adapted to sensitize the marker when moved in the second direction.

40. The apparatus of claim 35, wherein the first magnet rests at a position where it is unable to deactivate the marker.

41. The apparatus of claim 35, further including a rest location for the magnet, wherein the first magnet is unable to deactivate the marker when located at the rest location.

* * * * *